US006289777B1

(12) United States Patent
Hartmann et al.

(10) Patent No.: US 6,289,777 B1
(45) Date of Patent: Sep. 18, 2001

(54) PAPER WEB FOR A WEB FED ROTARY PRINTING PRESS

(75) Inventors: Manfred Wolfgang Hartmann, Elfershausen; Horst Bernhard Michalik, Höchberg, both of (DE)

(73) Assignee: Kongg & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/424,862

(22) PCT Filed: Jun. 8, 1998

(86) PCT No.: PCT/DE98/01542

§ 371 Date: Jun. 12, 1999

§ 102(e) Date: Jun. 12, 1999

(87) PCT Pub. No.: WO98/55278

PCT Pub. Date: Dec. 10, 1998

(30) Foreign Application Priority Data

Jun. 6, 1997 (DE) ..... 197 23 750

(51) Int. Cl.[7] ..... B26F 3/02; B26F 1/04; B41F 13/03

(52) U.S. Cl. ..... 83/30; 83/304; 83/342; 83/678

(58) Field of Search ..... 83/304, 305, 30, 83/342, 672, 660, 678, 337, 695

(56) References Cited

U.S. PATENT DOCUMENTS

| | | | | |
|---|---|---|---|---|
| 707,540 | * | 8/1902 | Baruch | 83/342 |
| 1,499,676 | * | 7/1924 | Marquette | 83/342 |
| 1,665,834 | * | 4/1928 | Ayer | 83/342 |
| 1,693,589 | * | 12/1928 | Bolton | 83/342 |
| 2,316,054 | | 4/1943 | Davis et al. . | |
| 2,761,513 | * | 9/1956 | Stram | 83/304 |
| 3,059,842 | | 10/1962 | Wadey . | |
| 3,554,070 | * | 1/1971 | Boyd | 83/678 |
| 3,570,337 | * | 3/1971 | Morgan | 83/342 |
| 4,552,316 | | 11/1985 | Dropczynski et al. . | |
| 4,596,546 | | 6/1986 | Schellenberg . | |
| 4,775,110 | | 10/1988 | Welp et al. . | |
| 4,805,501 | | 2/1989 | Nuttin . | |
| 5,881,622 | | 3/1999 | Kaipf . | |

FOREIGN PATENT DOCUMENTS

| | | |
|---|---|---|
| 270911 | 10/1912 | (DE) . |
| 1019321 | 9/1954 | (DE) . |
| 3140511 A1 | 10/1981 | (DE) . |
| 3611895 A1 | 4/1986 | (DE) . |
| 0054907 A2 | 6/1982 | (EP) . |
| 0723862 A1 | 1/1996 | (EP) . |
| 0744367 A2 | 5/1996 | (EP) . |
| 2460776 | 7/1979 | (FR) . |
| WO 87/04658 | 2/1987 | (WO) . |

* cited by examiner

*Primary Examiner*—Kenneth E. Peterson
*Assistant Examiner*—Stephen Choi
(74) *Attorney, Agent, or Firm*—Jones, Tullar & Cooper, PC

(57) ABSTRACT

A moving paper strip or web is cross-perforated by a perforation roller in cooperation with a counter roller. The perforation roller has a plurality of axially spaced retractable perforation plungers. These perforation plungers form a helical line of plungers on the circumference of the perforation roller to perforate left rising or right rising tear line extending in a direction oblique to a paper web movement direction to form a draw-in tip after separating the paper web along the tear line.

1 Claim, 5 Drawing Sheets

PAPER WEB FOR A WEB FED ROTARY PRINTING PRESS

FIELD OF THE INVENTION

The present invention is directed to a method for processing a paper web, and a paper web processed in accordance with the method. The paper web is provided with a transverse tear line along which the tear resistance of the web is reduced, as the web travels through the press.

DESCRIPTION OF THE PRIOR ART

A perforating unit with pins, and cooperating holes, arranged on rollers is known from DE-PS 10 19 321. These pins, or holes, are each located on, or in, the casing of a roller, wherein each roller has an appropriate casing.

WO 87/04658 shows a device for transversely perforating a paper web. Here, a perforation cutter is arranged helically on a perforation cylinder.

FR 2460776 discloses a device for perforating, wherein the arrangement of the perforating needles can be changed.

EP 0723862 A1 describes a web of material which, on its way through a web-fed rotary printing press and after leaving the roll changer, is cut along a line extending in a direction transverse to the paper web movement direction, and is brought to another web guide.

SUMMARY OF THE INVENTION

The object of the present invention is directed to providing creating a paper web which, while moving on its way from the roll changer through the web-fed rotary printing press, can be transversely cut at a preselectable point without a cutter device.

In accordance with the present invention, this object is attained by the provision of a line of perforations in the paper web. These perforations are formed in a direction transverse to the paper web movement direction. The perforations form a tear line along which the tear resistance of the paper web is reduced. A forming roller with perforation plungers is used to form the perforations. The perforation plungers are arranged axially on the roller in groups.

The advantages to be obtained by the present invention lie, in particular, in that, for example, a paper web moving at the draw-in speed quickly receives a transverse perforation in the form of a transverse tear line of reduced tear resistance, whose location can be predetermined. It is made possible in this way, for example, to transversely separate an already longitudinally cut half- or quarter-width paper web at the predetermined breaking point, and to convey a new draw-in tip, produced in this way, for example over turning bars, by means of a draw-in device, to another longitudinal folding hopper unit or to a mixing deck of a web-fed rotary printing press. It becomes possible, in this way, for example in connection with a flying plate change, to change the number of pages of a newspaper in the shortest possible time.

BRIEF DESCRIPTION OF THE DRAWINGS

A preferred embodiment of the present invention is represented in the drawings and will be described in greater detail in what follows. Shown are in.

DESCRIPTION OF THE PREFERRED EMBODIMENT

Figure 1:
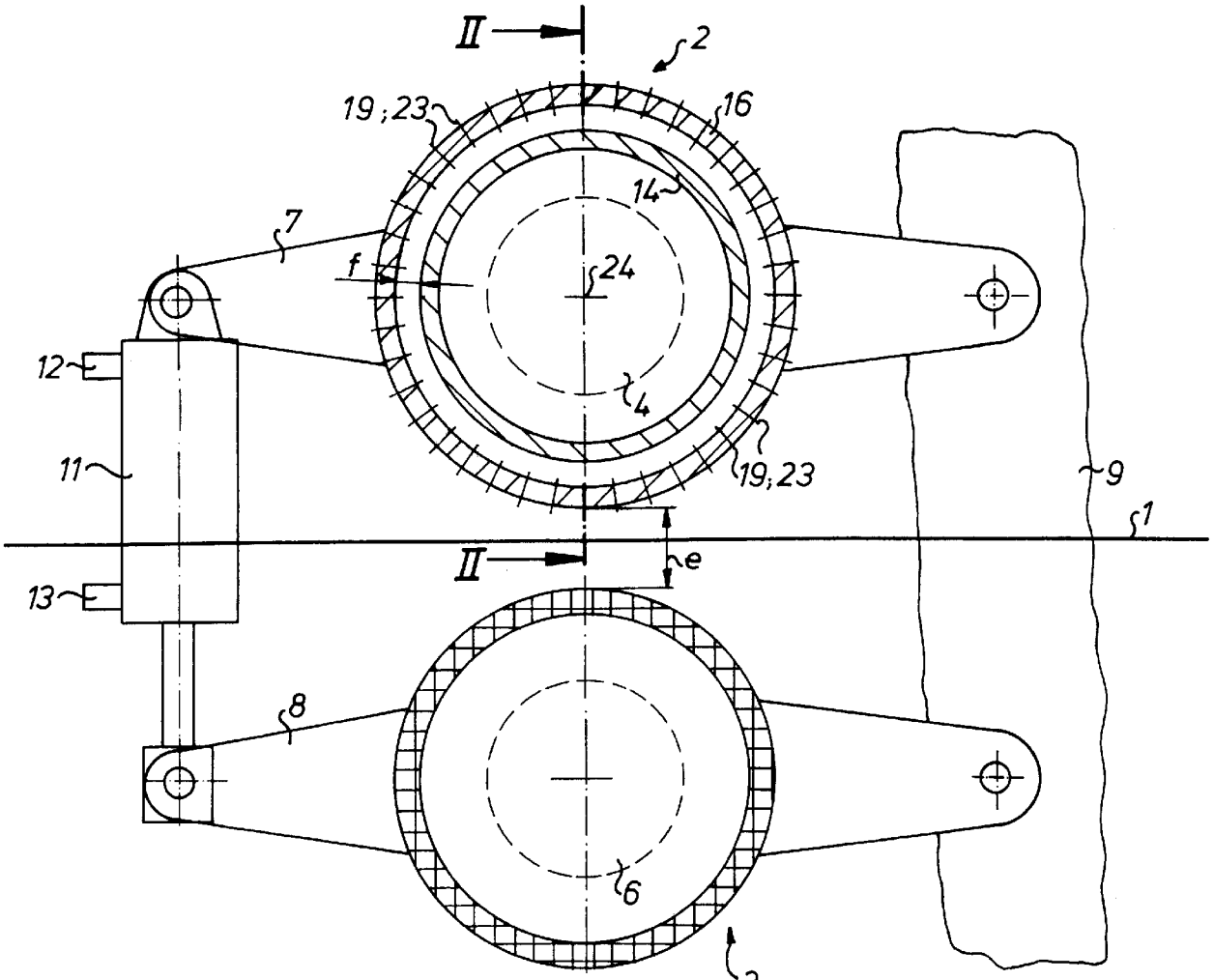
FIG. 1, a cross sectional view through a schematic representation of a device in accordance with the invention, FIG. 2, a longitudinal section taken along line II—II of FIG. 1 through a perforation roller, FIG. 3, an enlarged representation of a perforation plunger element in accordance with FIG. 1 in an enlarged view with the perforation plunger in a position of rest, FIG. 4, a representation analogous to FIG. 4, but with the perforation plunger in the work position, and in FIG. 5, a schematic representation of the perforating options for a draw-in tip of a paper web.

A device for transversely perforating a moving paper web 1, in accordance with the present invention, and as seen in FIG. 1, consists of two rollers which can be placed against the paper web 1, a perforation roller 2 and a counter roller 3. Each one of the rollers 2, 3 has shaft journals 4, 6 on both ends, which journals are seated in the center of support arms 7, 8 respectively. On each side of the machine, a first end of each support arm 7, 8 is pivotably seated in the lateral frame 9—only one of which is represented—, while one double acting work cylinder 11, for example a pneumatic cylinder provided with working fluid connectors 12, 13, is arranged between the second ends of the support arms 7, 8.

In the position of rest, as depicted in FIG. 1, both rollers 2, 3 are spaced apart from each other at a spacing distance "e", for example 20 mm. In a work position, not specifically represented, both rollers 2, 3 act on the paper web 1, or respectively mesh with each other.

Figure 2:
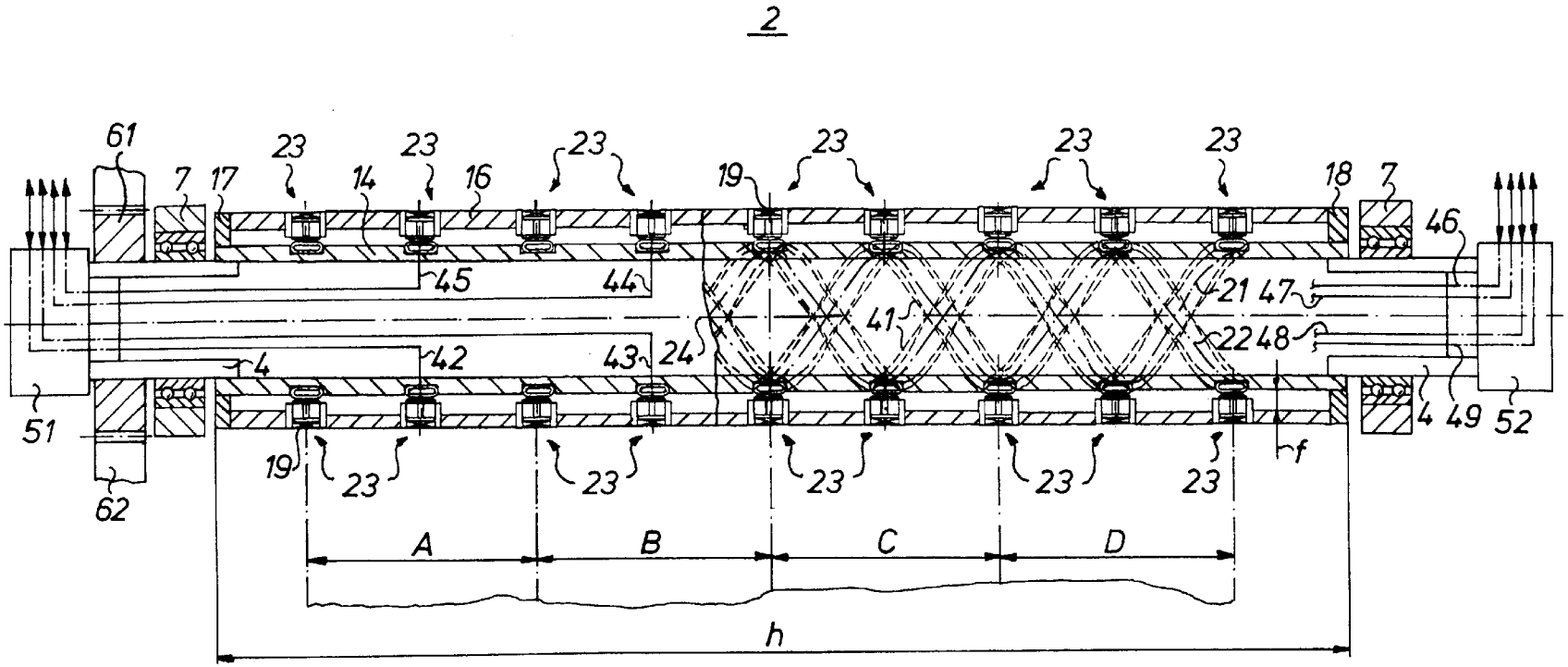

The perforation roller 2 consists of a perforation tube 14, for example, which supports the shaft journals 4 on both ends sides. A cylinder-shaped perforation roller casing 16 is coaxially arranged around the tube 14 and is connected with the tube 14 via lateral disks 17, 18, as seen in FIG. 2. The tube 14 and the cylinder-shaped casing 16 are arranged at a spacing distance "f" in respect to each other. Extendible perforation plungers 19 are arranged, spaced apart from each other and in a helical pattern, in the casing 16 of the perforation roller 2. The perforation plungers 19 are, for example, located on a first helical perforation plunger track 21, which extends, for example, four times helically over 360° over the entire width "h" of the perforation roller, as shown in FIG. 2. In addition to the first helical perforation plunger track 21, a second helical perforation plunger track 22 extends over the width of the perforation roller 2. This second helical perforation plunger track 22 is offset by 180° with respect to the first perforation plunger track 21 and is winding in the opposite direction. Second perforation plunger track 22 also has perforation plungers 19 which are spaced apart from each other.

Figure 3:
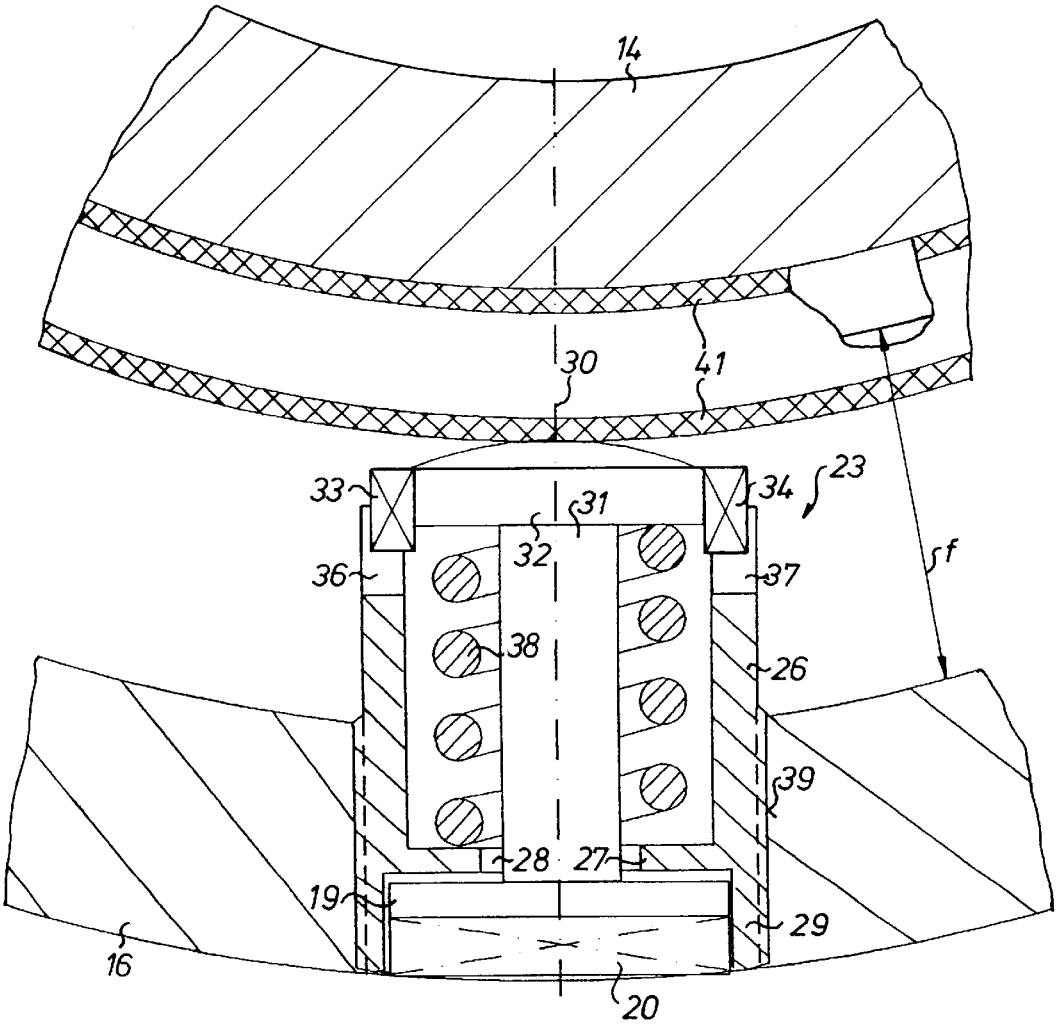
Figure 4:
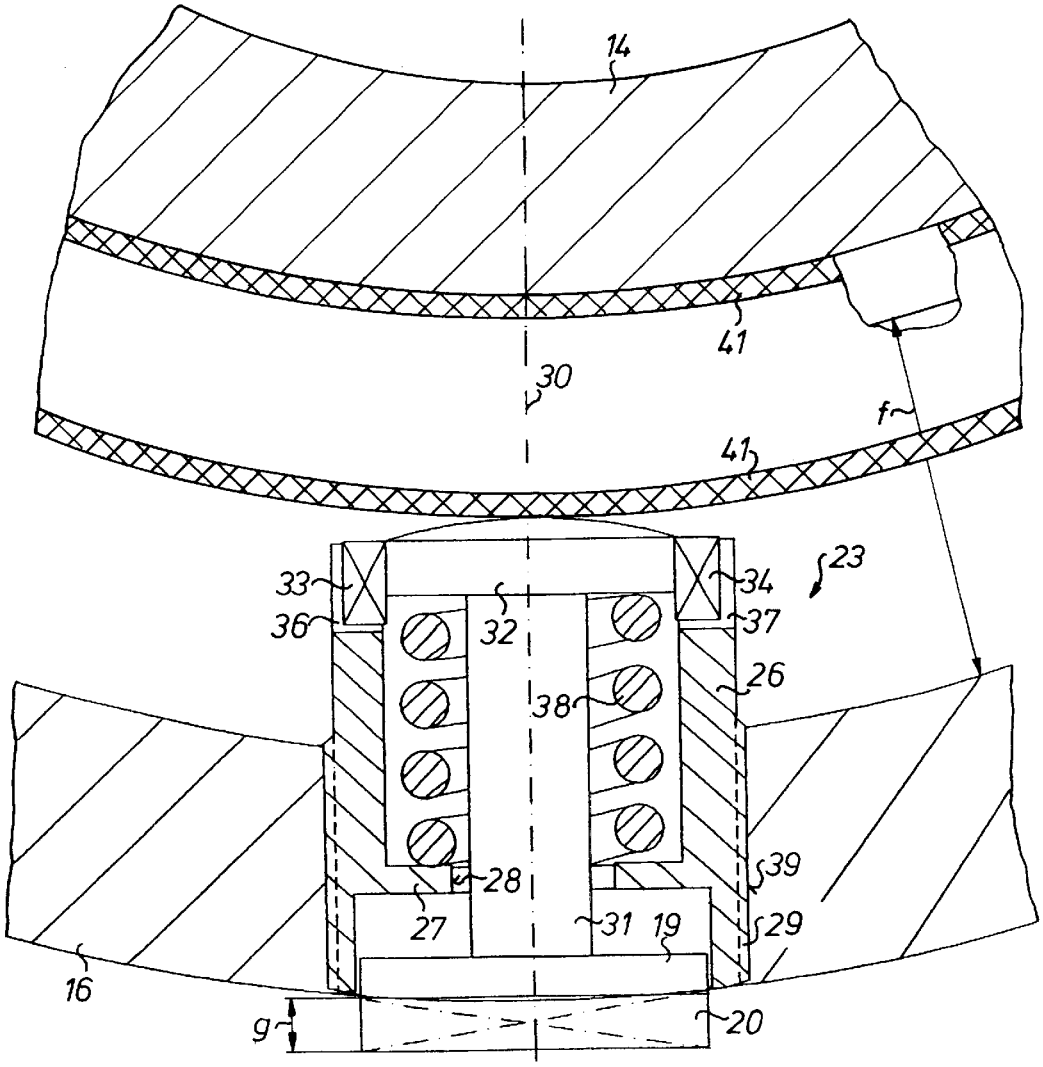

Each perforation plunger 19 is assigned to a perforation plunger element 23 and can be moved through a distance "g", for example of four millimeters, out of the casing 16 in the radial direction of the perforation roller 2, as depicted in FIGS. 3 and 4.

The perforation plunger element 23 consists of a sleeve 26, open in the radial direction with respect to the axis of rotation 24 of the perforation roller 2, and having a bore 28 in the sleeve bottom 27. A tube-like plunger guide 29 is formed on an outer end of the sleeve 26, adjoining the sleeve bottom 27 and, whose end facing away from the sleeve is flush with the casing 16 of the perforation roller 2.

The sleeve 26 receives and supports a tappet 31, which can be moved back and forth in the direction of the longitudinal axis of the sleeve and whose first or radially outer end projects through the bore 28 and supports the perforation plunger 19, which is embodied to be circular in a view from above and includes a cutter 20. A tappet head 32, which is embodied somewhat dome-shaped at its inner end and which has two, for example finger-like guides 33, 34 on its sides, which engage lateral recesses 36, 37 of the sleeve 26, is arranged on the second or radially inner end of the tappet 31. A compression spring 38 is arranged coaxially with the tappet 31 between the tappet head 32 and the sleeve bottom 27. Each perforation plunger element 23 has an exterior thread and has been screwed into a threaded bore 39 located in the casing 16.

Figure 5:
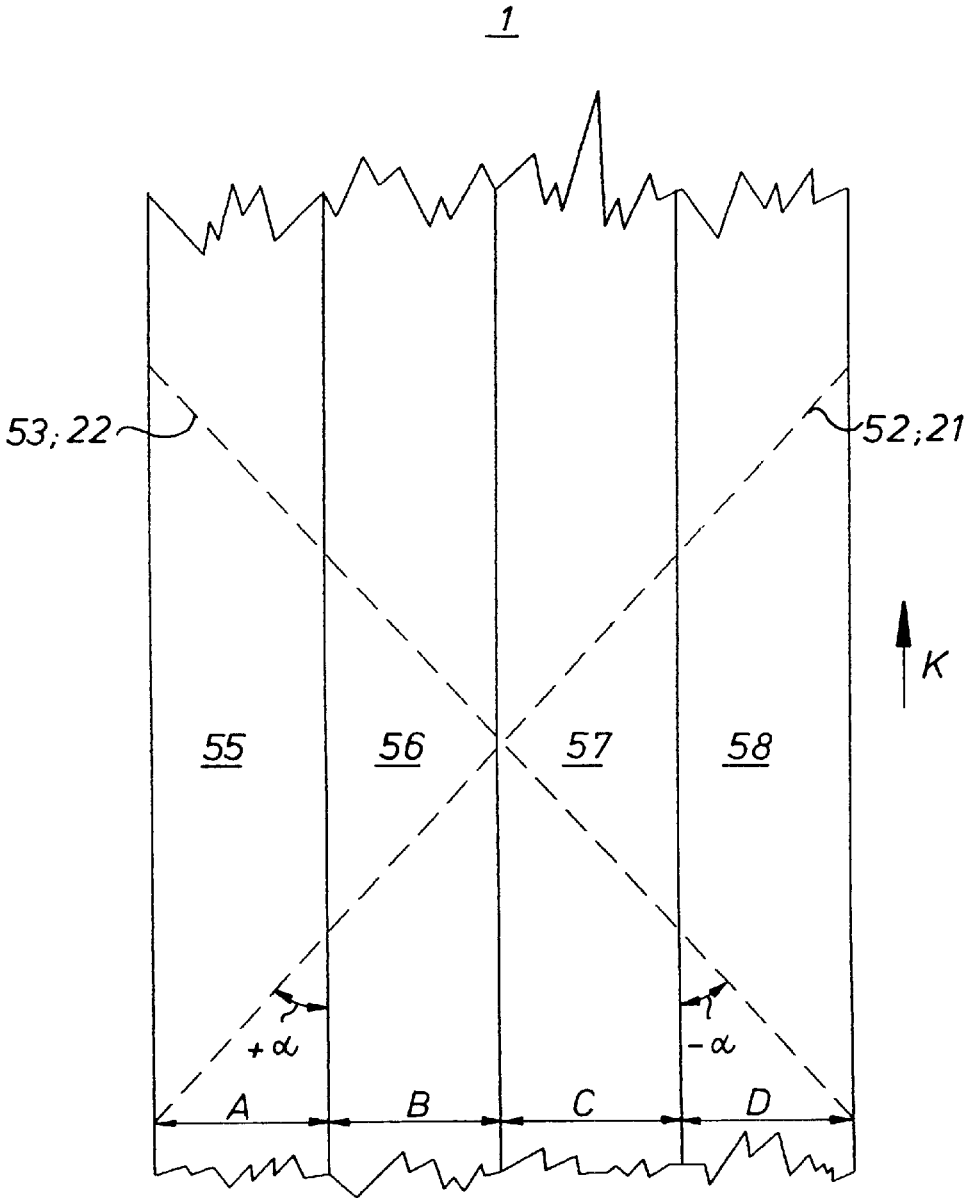

Each one of the first and second helical perforation plunger tracks 21, 22, which are offset by 180° from each other, has been divided into four partial perforation plunger tracks A, B, C, D, as seen in FIG. 2 which are each one-quarter of the width of the paper web. This results in the partial perforation plunger tracks A21, B21, C21, D21 in the first helical perforation plunger track 21, and in the partial perforation plunger tracks A22, B22, C22, D22 in the second helical perforation plunger track 22. Each partial perforation plunger track A to D has a number of perforation plunger elements 23, which are spaced apart from each other, for example at a distance of 20 mm. Each partial perforation plunger track A to D is arranged helically over 360° on the casing 16 of the perforation roller 2 as shown in FIGS. 2 and 5. All of the perforation plunger elements 23 of each partial perforation plunger track A to D can be actuated by means of a separate and separately actuable hose 41, which can be charged with compressed air.

For this purpose, every hose 41 of a partial perforation plunger track A to D of the first and second perforation plunger tracks 21, 22 is connected by means of a line 42 to 49, respectively. The lines 42 to 45 are conducted over the left shaft journal 4 to a known revolving inlet 51, and the lines 46 to 49 are conducted over the right shaft journal 4 to a revolving inlet 52. The revolving inlets 51, 52 are connected with known, controllable compressed air supply devices. The hoses 41 of the partial perforation plunger tracks A21 to D22 are guided in helical grooves, for example, which extend on the tube 14 as seen in FIGS 2–4. The counter roller 3 has a casing or cover 59 made of a soft plastic material, for example polyurethane of a hardness of 80 to 85 Shore.

In accordance with another preferred embodiment, the counter roller 3 may have bristles on its circumference, against which the paper web 1, as well as the perforation plungers 19, are pressed.

Finally, the counter roller 3 can also have holes on its circumference for receiving the perforation plungers 19 with the cutters 20. To this end, it is necessary that the counter roller 3 and the perforation roller 2 rotate synchronously in the working state.

At least the perforation roller 2 can be driven synchronously with respect to the passage or travel speed of the paper web 1. This can be achieved by means of a toothed belt pulley 61, which is arranged, fixed against relative rotation, on a shaft journal 4 and can be driven by means of a toothed belt 62 of a toothed belt drive, as shown in FIG. 2.

Driving of the perforation roller 2, as well as possibly also that of the counter roller 3, can also be provided by means of electric motors, flanged on the rollers 2, 3, wherein the circumferential speed of the rollers 2, 3 is synchronous with respect to the passage or travel speed of the paper web 1.

The functioning of the device of the present invention is as follows.

Possible oblique perforation lines 52, 53 in a paper web 1, which extend from either left to right or from right to left, and at an angle $+\alpha$, or respectively $-\alpha$, in respect to the conveying or travel direction K of the paper web 1, are represented in FIG. 5. The paper web can be longitudinally cut and divided into partial paper webs 55 to 58 of either a quarter or half a partial paper web, or into a combination of half and quarter partial paper webs.

It is possible, for example by actuating the perforation plungers of the partial perforation track A21, to create a now draw-in tip on the right side of the quarter-wide partial paper web 55, and by actuating the perforation plungers 19 of the partial perforation plunger track C22 to create a draw-in tip on the left side of the quarter-wide partial paper web 57. Preferably the perforation plungers 19 can be actuated in groups A21 to D21, or respectively A22 to D22, as described previously. However, the perforation plungers 19 can also be individually actuated.

The perforation plungers 19, which have been extended by the plunger stroke, through the distance "g" out of the casing 16 by being charged with compressed air, as shown in FIG. 4 work against the paper web 1 and the counter roller 3, which has been placed against it by operation of the work cylinder 11. After the compressed air has been vented, the perforation plungers are each retracted by the force of the spring 38 back into the plunger guide 29 until they rest against the sleeve bottom 27.

Instead of using the helically extending inflatable hoses 41, the perforation plunger elements 23 can also each be extended by means of individual compressed air actuation cylinders, not specifically represented. Here, the compressed air actuation cylinders can each be separately actuated for each partial perforation plunger track A21 to D21, as well as A22 to D22.

Moreover, a multitude of options for designing perforations are provided.

For example, if a 1/1 paper web 1 is to be transversely perforated from left to right along the perforation line 52, as shown in FIG. 5, first the perforation plungers 19 of the partial perforation plunger track A21 are extended. After these have cut the perforation into the partial paper web 55, the perforation plungers 19 of the partial perforation plunger track A21 are retracted, and the perforation plungers 19 of the partial perforation plunger tracks B21, C21 and D1 are respectively extended and retracted until the perforation line has been completely cut, also in the areas of the partial paper webs 56, 57 and 58.

Thereafter, the perforations cut in the above described way can be torn open and the partial paper webs can be moved to another track guide or to a plurality of other guide tracks.

In accordance with another preferred embodiment, the first, or the second perforation plunger track 21, 22 can helically extend altogether only over 360° across the entire perforation roller width "h". This is advantageous if it is intended to perforate a paper web 1 over the entire width at an angle of 45°.

If a paper web 1 is to be perforated at a different oblique angle $\alpha$ than 45°, as depicted in FIG. 5, for example in the range $\pm\alpha$ of 30° to 60°, then in the first case more than 360° of rotation and in the second case less then 360° of rotation of the helical perforation plunger tracks 21, 22 over the perforation roller width "h" is required.

This respectively applies in the same way for cutting perforations into partial paper webs 55 to 58.

Besides the above described measures for the defined local weakening of the web/partial paper webs, the following devices can also be employed:

a) the perforation can consist of a plurality of spaced apart cuts in the web cross section, b) the weakening can take place by the application of a so-called water track, for example by spraying water or another liquid.

While a preferred embodiment of a paper web for a web-fed rotary printing press in accordance with the present invention has been set forth filly and completely hereinabove, it will be apparent to one of skill in the art that a number of changes in, for example the paper web supply device, the specific type of printing press used, and the like could be made without departing from the true spirit and scope of the present invention which is accordingly to be limited only by the following claims.

What is claimed is:

1. A method for providing a tear line in a paper web as said paper web is passing through a web-fed rotary printing press in a paper web movement direction including:

providing a perforation roller in said web-fed rotary printing press in said paper web movement direction and after said paper web has left a roll changer of said web-fed rotary printing press;

providing selectively operable groups of left and right rising paper web perforating elements on said perforation roller;

actuating at least one of said groups of left and right rising paper web perforating elements;

using said actuated at least one group of perforating elements and perforating said paper web;

defining a tear line extending in a direction oblique to said paper web movement direction and along which tear line the tear resistance of the paper web is reduced using said group of perforations in said paper web, said tear line being selectively right and left rising in respect to said paper web movement direction;

separating said paper web along said selectively left and right rising tear line; and bringing said separated paper web to a paper web guide.

* * * * *